US006067724A

United States Patent [19]

Depoyian

[11] Patent Number: 6,067,724

[45] Date of Patent: May 30, 2000

[54] INTERCHANGEABLE BRUSH HEAD HAIR DRYER

[76] Inventor: Jacques Depoyian, 6720 E. Mississippi Ave., Unit E, Denver, Colo. 80206

[21] Appl. No.: 09/122,733

[22] Filed: Jul. 27, 1998

Related U.S. Application Data

[63] Continuation-in-part of application No. 08/901,590, Jul. 28, 1997.

[51] Int. Cl.[7] ..... A45D 17/08

[52] U.S. Cl. ..... 34/97; 392/383; 392/384; 392/385

[58] Field of Search ..... 34/96, 97

[56] References Cited

U.S. PATENT DOCUMENTS 3,890,984 6/1975 Lesetar ..... 132/9
3,986,272 10/1976 Feierabent ..... 34/97

*Primary Examiner*—Henry Bennett
*Assistant Examiner*—Malik N. Drake
*Attorney, Agent, or Firm*—Ancel W. Lewis, Jr.

[57] ABSTRACT

A hair drying assembly has a hair dryer that is particularly suited for using one of a plurality of interchangeable brush heads. The hair dryer has an ellipsoid shaped housing with a cylindrical outlet section at one end and a pivotal grip section at the other end. The handle is pivotally and removably attached to the housing. In one embodiment the handle is attached with air inlet passages formed by legs connecting to the housing and additional slots at the inlet end of the housing. Control buttons for regulating the motor are on the pivotal handle grip section. Outlet passages are provided in the outlet section. One form of brush head is hollow with peripheral openings and bristles extending therethrough and another brush head is solid with the bristles fixedly attached. In another embodiment there is a bifurcated handle with spaced arms that pivotally connect to the housing inwardly of the air inlet end.

31 Claims, 4 Drawing Sheets

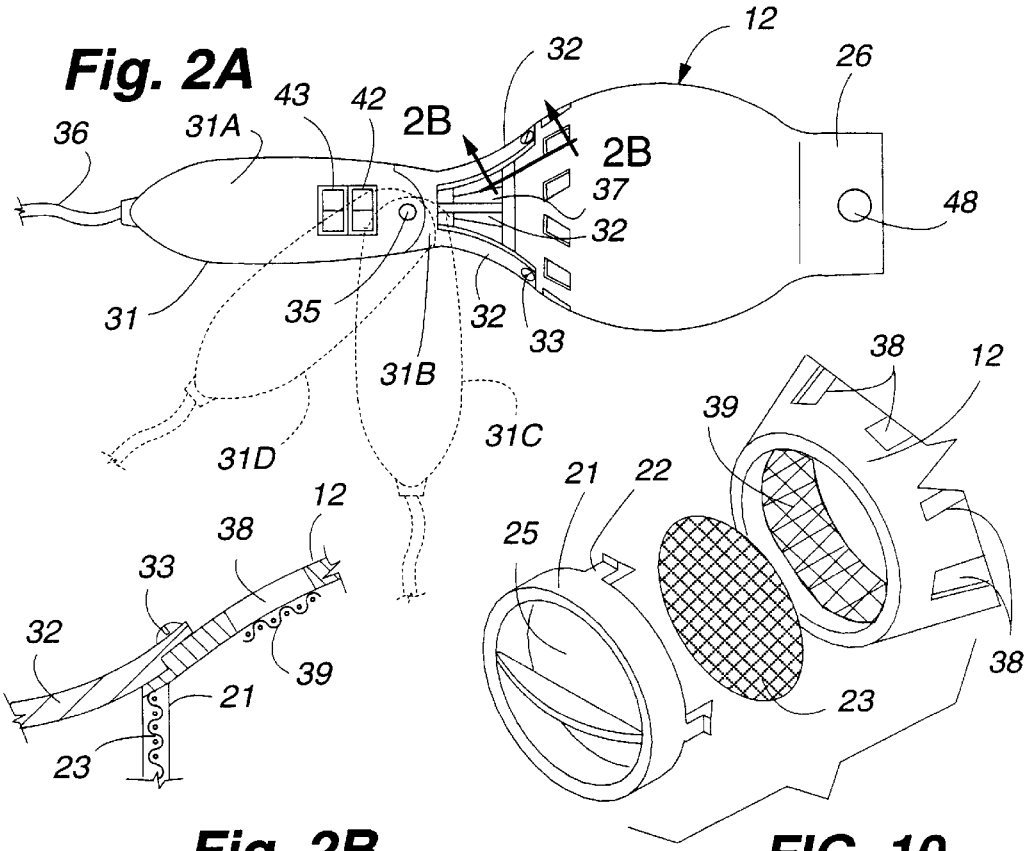
Fig. 2B
FIG. 10
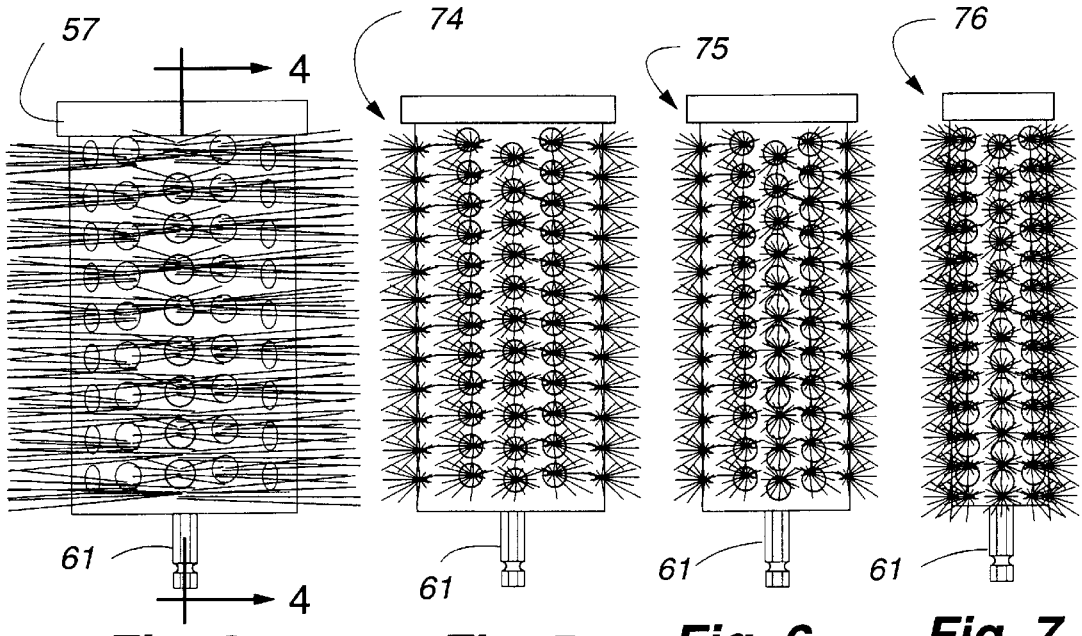
Fig. 3 Fig. 5 Fig. 6 Fig. 7

INTERCHANGEABLE BRUSH HEAD HAIR DRYER

This application is a continuation-in-part of application Ser. No. 901,590 filed Jul. 28, 1997.

TECHNICAL FIELD

This invention relates to hair dryers and more particularly to a novel hair drying assembly having interchangeable different brush heads.

BACKGROUND ART

Hair dryers in current use have only one rigidly attached brush head. There is a need for improvements in hair dryers and a need for a hair dryer in which different styles and different sizes and shapes of brush heads may be used for a varied hair treatment.

DISCLOSURE OF THE INVENTION

A hair drying assembly disclosed includes a hair dryer with a first coupling at an air outlet end and interchangeable brush heads of selected types, sizes and shapes with a second coupling that releasably interconnects to the first coupling. In one form the brush head has a hollow core closed at the distal end with peripheral air flow openings through which a plurality of radially extending bristles project. The air flows from the hair dryer through the inside of the core out the openings and along the outside of the core past the bristles. In another form the brush head has a solid core with bristles attached to the core and the air flows along the outside of the core and between the bristles. The hair dryer has an ellipsoid shaped housing with axial inlet openings, a removable, pivotal handle, a cylindrical outlet section with axial outlet openings and control buttons actuating switches for regulating on/off and speed of the motor. A first embodiment has a handle with a pivoted section with spaced connecting arms that connect to the housing. A second embodiment has a bifurcated handle with opposed connecting arms that pivotally connect to the housing a distance in from the inlet end. There is also means to lock the handle at in line and right angle positions.

BRIEF DESCRIPTION OF THE DRAWINGS

Details of this invention are described in connection with the accompanying drawings which like parts bear similar reference numerals in which:

FIG. 2A is a side elevation view of the hair dryer shown in FIG. 1

FIG. 2B is a sectional view taken along line 2B—2B of FIG. 2A.

FIG. 3 is a side elevation view of the brush head shown in FIG. 1.

FIG. 5 is a second size of interchangeable brush head.

FIG. 6 is a third size of interchangeable brush head.

FIG. 7 is a fourth size of interchangeable brush head.

FIG. 10 is an exploded view of the air inlet end of the hair dryer housing with the filter and air inlet end hub shown removed.

DETAILED DESCRIPTION

Figure 1:
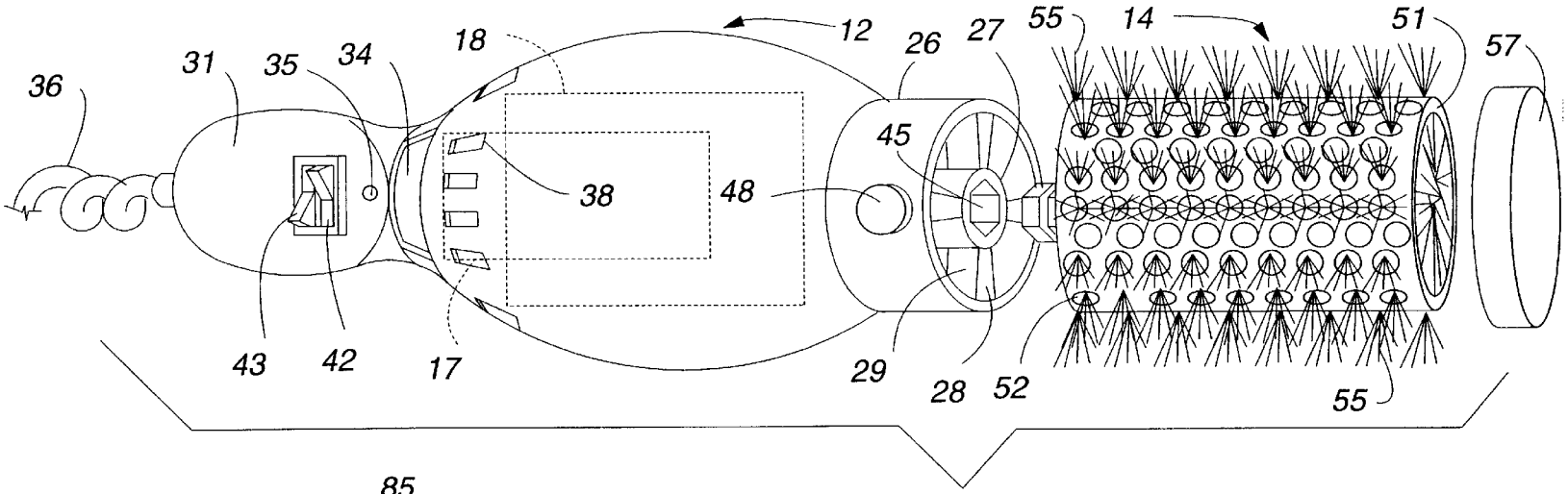
FIG. 1 is an exploded view of the hair drying assembly showing a hair dryer and a brush head separated and with the end cap separated from the brush head.

Referring now to the drawings, there is shown a hair drying assembly embodying features of the present invention which, generally stated, includes a hair dryer 12 and an interchangeable brush head 14 removably attached to the hair dryer 12. The hair dryer 12 shown includes a hollow main housing 16 enclosing an electric motor 17 driving a blower 18 shown schematically in block form in dashed lines in FIG. 1. The motor and blower may be of the type presently being furnished in currently available hair dryers. The housing 16 is in the shape of an ellipsoid for being hand-held by the user and has an inlet end hub 21 with a plurality of circumferentially spaced fastening legs 22 with flanges that insert into the inside of the housing and fit against an inside edge (not shown) to releasably attach at the inlet end of the housing and hold a screen 23 across the air inlet end of the housing to keep foreign particles, lint etc. out of the motor and blower. The hub 21 defines an air inlet air flow passage 25 for air to flow into the housing 16.

A plurality of circumferentially spaced slots 38 are provided in the housing adjacent the inlet end. These slots allow for additional air flow into the inlet end of the housing. A screen 39 shown on the inside of the housing covers each slot 38 to prevent foreign particles, lint, etc. from entering the inside of the housing.

The housing 16 has a cylindrical outlet section 26 in which there is mounted an outlet end hub 27 by means of four circumferentially spaced, radially extending arms or spokes 28 to define four axially extending outlet air flow passages 29. A handle 31 is mounted at the inlet end of the housing 16. The handle 31 shown in full lines is coaxial with the main housing and has three circumferentially spaced connecting arms 32 that are removably fastened at the ends to the housing by fastening means shown as a screw 33 to allow the handle to be readily detached from the housing.

The handle 31 has a stationary section 31A which supports the legs 31 and a movable grip section 31B that pivotally connects to the stationary section 31A by a pivot member 35. This pivotal handle feature enables the handle to pivot to and be set at a second position at right angles to the first position shown in dashed lines at 31C and be set at selected third positions between the first and second positions shown in dashed lines at 31D.

The connecting arms 32 define inlet air flow passages 34 in flow communication with passage 25 so that when the blower 18 produces a stream of air the air is drawn through passages 34 and 25 through the inside of the housing and out outlet passage 29. Electric power is provided via an electric cord 36 that connects at the end of the handle and extends through the handle with an electrical line 37 extending along the back arm 43 to connect power to the motor 17. A first control switch operatively associated with a first button 42 on the handle is for controlling on/off and for two motor speeds. A second control switch with a second button 43 controls temperature. A first coupling portion is a female socket that is provided by hub 27 having flat inner sides 45 in the form of a polygon and specifically a hexagon. A locking arrangement in the hub 27 includes a spring biased ball 47 and a button 48 on the exterior of the outlet section 26 arranged so that upon actuation of the button 48 the ball 27 is drawn back to release the brush head described hereafter.

Figure 4:
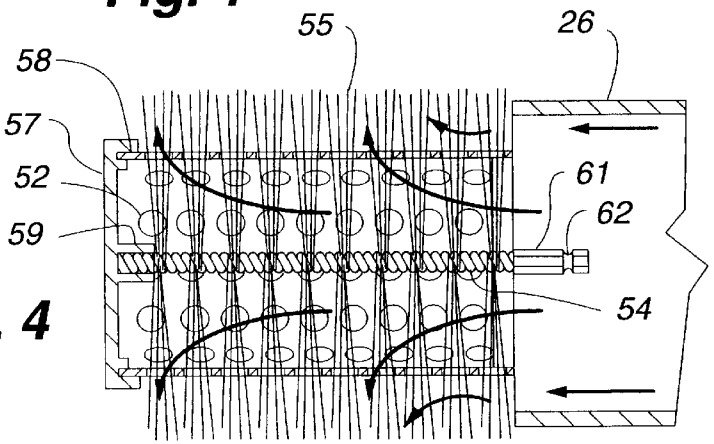
FIG. 4 is a sectional view taken along line 4—4 of FIG. 3 with a portion of the hub of the dryer shown and air flow indicated by arrows.

The interchangeable hair brush head 14 shown in FIGS. 1, 3 and 4 comprises a hollow cylindrical core 51 with a plurality of holes 52 in the periphery through which air will flow from the inside to the outside. A central hub 54 supports a plurality of radially extending bristles 55 that extend from the hub 54 through the holes 52 in the core. Air will pass through the core past the bristles as well as along the outside periphery of the core past the bristles. A removable imperforate end cap 57 preferably of plastic closes the distal end of the core. The end cap 57 has an outer annular groove 58 that fits over the end of the core and an inner hole 59 of a hub that receives the end of core 51 to removably secure the end cap to the core. A male coupling portion 61 shown is in the form of a shaft having a plurality of sides in the shape of a polygon, specifically a hexagon and extends beyond the opposite end of central hub 54. This shaft has a recess or detent 62 to receive a spring biased ball 47 to be locked in an operating position to the hub 27.

As illustrated in FIGS. 5, 6 and 7 these brush heads are provided as a set in different sizes. The second interchangeable brush head 74 shown in FIG. 5 is similar in construction to brush head 14 but of a smaller diameter. In FIG. 6 there is shown a third brush head 75 and in FIG. 7 a fourth brush head 76 similar in construction to brush head 14 but of still further smaller diameters. A set of interchangeable brush heads would typically have diameters of 2 inches, 1¾ inches, 1½ inches-and 1¼ inches.

Figure 8:
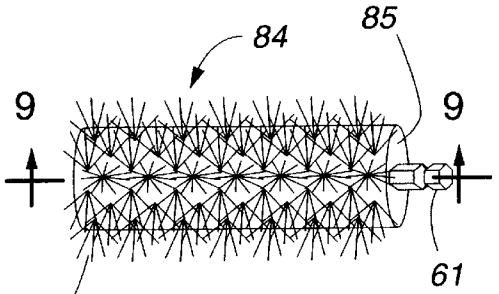
FIG. 8 is an alternative embodiment of a brush head having a solid core.
Figure 9:
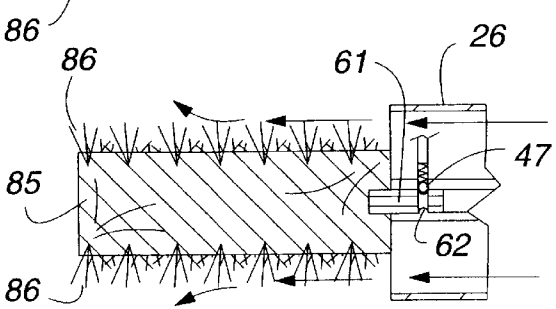
FIG. 9 is a sectional view taken along line 9—9 of FIG. 8 with the hub of the dryer shown and air flow indicated by arrows.
Figure 12:
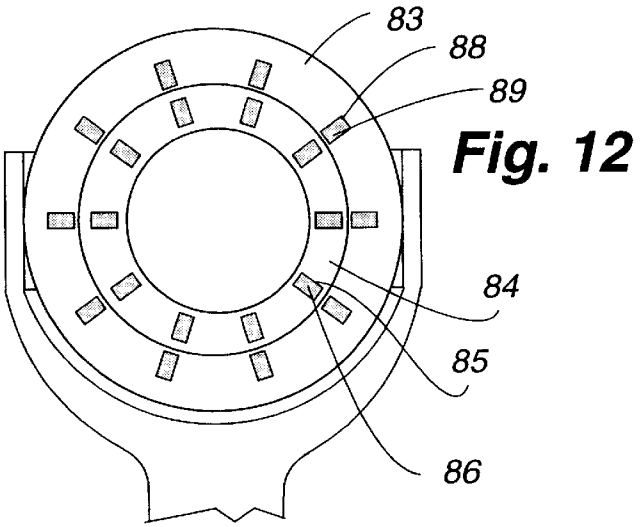
FIG. 12 is a rear elevation view of the hair drying assembly of FIG. 11 with the handle arms in the right angle position.
Figure 11:
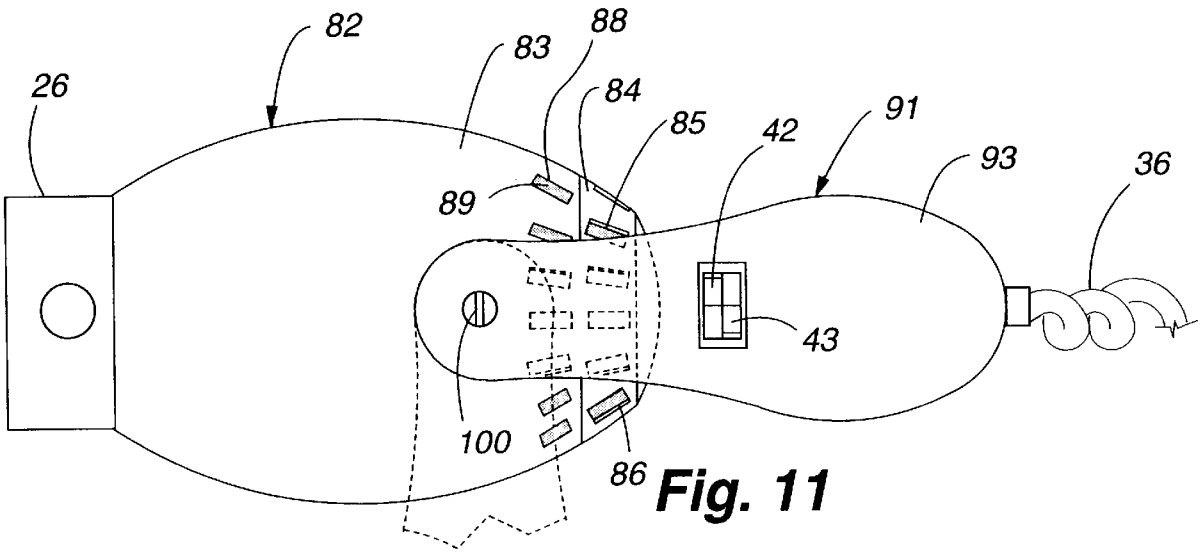
FIG. 11 is a side elevation view of another embodiment of the hair drying assembly embodying features of the present invention with the handle set at an in line position and the right angle position shown in dashed lines.
Figure 13:
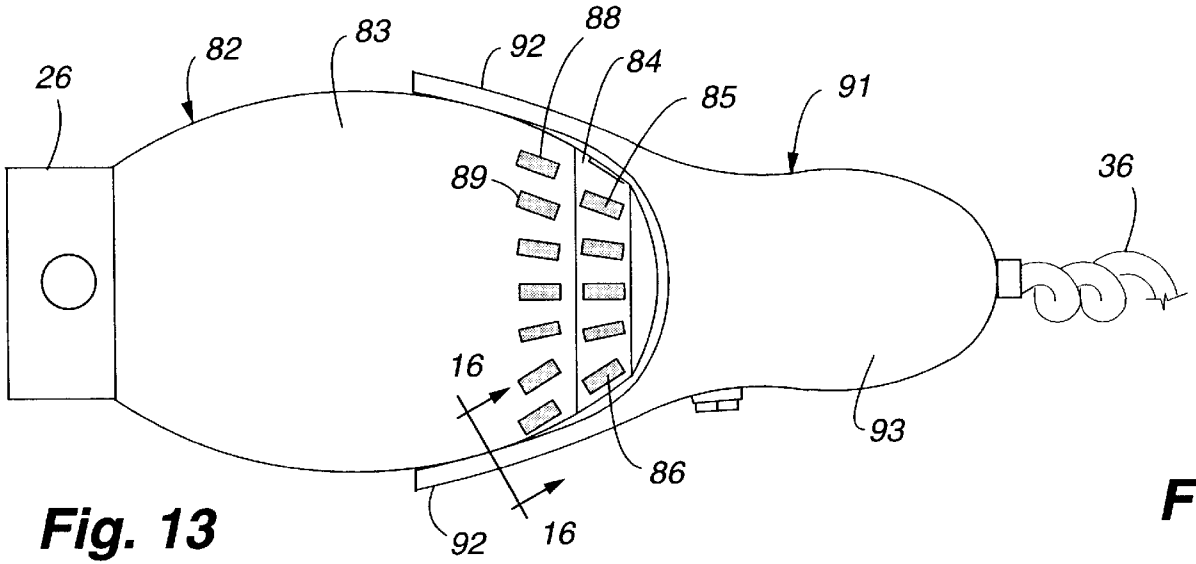
FIG. 13 is a top plan view of the hair drying assembly shown in FIG. 11.
Figure 14:
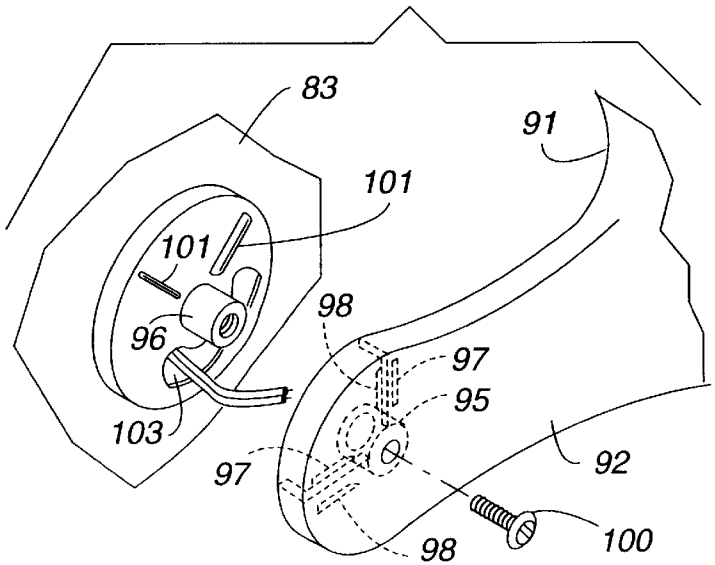
FIG. 14 is a fragmentary exploded perspective view showing the pivotal connection of one handle arm to the housing.
Figure 15:
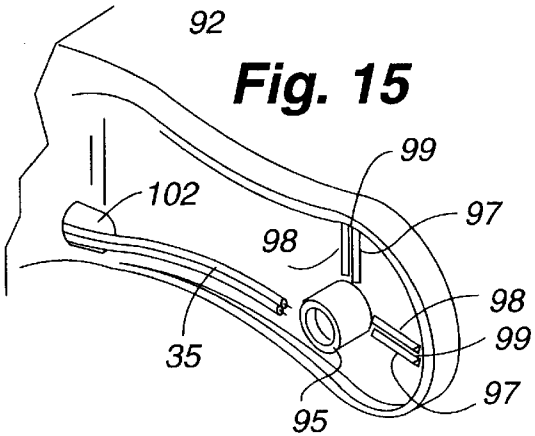
FIG. 15 is a fragmentary perspective view of the inside of one handle arm.
Figure 16:
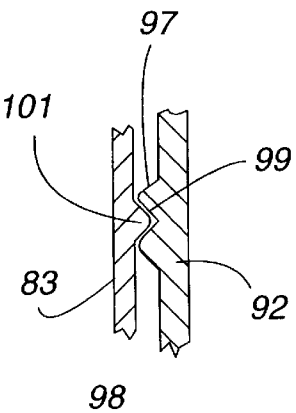
FIG. 16 is a sectional view taken along line 16—16 of FIG. 13 showing the locking feature of the handle.

Referring now to FIGS. 8 and 9 there is shown an alternative embodiment of an interchangeable brush head 84 having a solid core 85 preferably of wood into which the bristles 86 are imbedded. This embodiment has a male coupling portion 61 extending out from the end. Again this style may be provided as a set of different diameters and/or length sizes as above described.

In use with air supplied by the hair dryer the bristles will brush the hair and the air will flow over the hair. The different sizes and styles provide versatility and flexibility in doing a hair treatment with the present invention.

Referring now to FIGS. 11–16 of the drawings, there is shown another embodiment of the hair drying assembly embodying features of the present invention. This assembly shown, generally stated, includes a hair dryer 82 to which an outlet section 26 as previously described is attached to receive a selected interchangeable brush head. The hair dryer 82 shown includes a hollow main housing 83 enclosing an electric motor driving a blower similar to those described in the embodiment shown in FIG. 1. The housing 83 is in the shape of an ellipsoid for being hand-held by the user and has an inlet end hub 84 removably attached to the housing 83 as by a snap fit or threads. The inlet end hub 84 is closed at the end and has a plurality of circumferentially spaced air inlet openings 85 and a screen 86 across each air inlet opening 85 to keep foreign particles, lint etc. out of the motor and blower. The housing 83 is also shown as having a plurality of circumferentially spaced air inlet openings 88 and a screen 89 across each opening 88 as an optional feature for more air to flow into the housing 83.

A bifurcated handle 91 is mounted to the housing at the inlet end of the housing. The handle 91 (shown in a first position) is coaxial or in line with the longitudinal axis of the main housing and has a main section 93 for gripping by the user and two opposed, spaced connecting arms 92 that are pivotally and removably fastened to the housing inwardly a fixed distance from the air inlet end of the housing. The releasable fastening means shown allows the handle to pivot between first and second positions and be readily detached from the housing.

The pivotal connection shown is a hollow socket 95 extending in from the arm that receives a stub shaft 96 extending out from the housing with a screw 100 extending from the outside of the arm through the socket and threading into the end of the stub shaft 96.

Each arm 92 is shown as having two sets of a pair of V-shaped projections 97 and 98 forming a recess 99. The recess 99 is located at 90 degrees in relation to the axis of rotation of the arms so that one location corresponds to the in line position and the other the right angle position. The contour or shape of the arms 92 along the inside conforms to and is closely spaced to the external shape of the housing and end hub 84 in both positions to allow the length of the device to be as short as possible particularly in the in line position.

The housing is shown as having two V-shaped projections 101. On projection 101 fits in one recess 99 at the in line position and the other recess 99 at the right angle position. It is understood the projections could be on the handle-and the recess on the housing or located on the socket and stub shaft herein described.

One arm 92 has an aperture 102 and the housing 83 also has an aperture 103 through which the power line or cord 36 extends to connect power from a power source to the motor inside the housing 83. When the motor is turned on the blower produces a stream of air which is drawn through passages and through the inside of the housing and out outlet passages of outlet section 26. As with the earlier described embodiment electric power is provided via the electric power cord 36. Like the first embodiment a first control switch is operatively associated with a first button 41 on the handle 91 is for controlling on/off and for two motor speeds. A second control switch associated with a second button 42 controls temperature.

Although the present invention has been described with a certain degree of particularity, it is understood that the present disclosure has been made by way of example and that changes in details of structure may be made without departing from the spirit thereof.

What is claimed is:

1. A hair drying assembly comprising in combination:

a hair dryer including a housing enclosing a motor driving a blower to produce a stream of air that flows through an outlet end, said housing having a handle connected opposite said outlet end, a first hub at said outlet end supported by circumferentially spaced radial support arms, said first hub having a first coupling portion, said arms defining axial outlet air flow passages between said arms through which said stream of air flows and control means to selectively control the operation of said motor, and one of a plurality of interchangeable brush heads removably attached to said hair dryer, each of said heads having a core and bristles on said core and a second hub at one end of said core, said second hub having a second coupling portion that interfits with said first coupling portion to removably attach said head to said first hub.

2. A hair drying assembly as set forth in claim 1 wherein said handle is bifurcated having a main section and two oppositely disposed arms extending out from one end of said main section, each said arm being pivotally connected to said housing in from an air inlet end of said housing, to enable said handle to move between a first in line position and a second position at right angles to said first position, and means to lock said handle at either of said first and second positions.

3. A hair drying assembly as set forth in claim 2 wherein each of said arms have an inside contour that conforms to the shape of the exterior of the housing at the inlet end and is closely spaced with said housing in both of said first and second positions.

4. A hair drying assembly as set forth in claim 2 including an air inlet hub at the inlet end of said housing, said hub having a plurality of circumferentially spaced screened passages to pass air into said housing.

5. A hair drying assembly as set forth in claim 4 wherein said housing has a plurality of screened circumferentially spaced inlet air flow passages.

6. A hair drying assembly as set forth in claim 2 wherein said means to lock includes a projection on one of said housing and one of said arms and a recess on the other of said housing and one of said arms, said projection being received in said recess as said arm is rotated.

7. A hair drying assembly as set forth in claim 2 wherein said pivotal connection for said handle is provided by a stub shaft projecting out from opposite sides of said housing, a hollow socket extending in from each arm and a screw threading through each socket into an associated of said shafts.

8. A hair drying assembly as set forth in claim 2 wherein said housing and one arm have aligned apertures through which an electric power cord extends.

9. A hair dryer comprising:

a housing enclosing a motor driving a blower to produce a stream of air that flows through an outlet end, said housing having a handle connected at an inlet end for gripping by a user, said housing having an outlet end, a central hub at said outlet end supported by circumferentially spaced radial support arms defining axial outlet air flow passages between said arms through which said stream of air flows and control means to selectively control the operation of said motor, said housing being hollow and generally in the shape of an ellipsoid for being hand-held, said housing having a generally cylindrical outlet section, said handle being bifurcated having a main section and a pair of opposed spaced arms removably fastened to said housing inwardly of said inlet end, said arms being pivotally connected to said housing to move between a first position wherein said handle is in line with said housing and a second position wherein said handle is at right angles to said housing, and means to lock said handle at either of said first and second positions.

10. A hair drying assembly as set forth in claim 1 wherein said core is hollow and is generally cylindrical and has a plurality of holes in the periphery through which air is passed from the inside to the outside and a plurality of bristles mounted inside said core on a center hub and extending beyond said core.

11. A hair drying assembly as set forth in claim 10 wherein said core has an end closure opposite said second hub to prevent air flow through a distal end of said head.

12. A hair drying assembly as set forth in claim 11 wherein said end closure is an imperforate plastic cap that removably fastens to said core.

13. A hair drying assembly as set forth in claim 10 wherein said core is a metal.

14. A hair drying assembly as set forth in claim 13 wherein said metal is aluminum.

15. A hair drying assembly as set forth in claim 1 wherein said core is solid with the bristles mounted in said core and the air directed along said core over the external surface of said core and past said bristles.

16. A hair drying assembly as set forth in claim 15 wherein said core is wood.

17. A hair drying assembly as set forth in claim 1 wherein said first coupling portion is a female socket having inner sides disposed to form a polygon and including locking means to releasably lock said brush head to said second coupling portion.

18. A hair drying assembly as set forth in claim 17 wherein said polygon is a hexagon.

19. A hair drying assembly as set forth in claim 1 wherein said first coupling portion is supported by four circumferentially spaced, radially extending arms defining axial inlet air flow passages.

20. A hair drying assembly as set forth in claim 1 wherein said second coupling portion is a male extension having outer sides disposed to form a polygon that is complementary in shape with said socket and sized to be slidably received in said socket.

21. A hair drying assembly as set forth in claim 20 including locking means on a front cylindrical extension of said housing to releasably lock said male extension in said socket.

22. A hair drying assembly as set forth in claim 21 wherein said locking means includes a button on said housing which upon actuation by a user releases a spring biased ball engaging a recess in said male extension.

23. A hair drying assembly comprising in combination:

a hair dryer including a housing enclosing a motor driving a blower to produce a stream of air that flows through an outlet end, said housing having a handle connected opposite said outlet end, a first hub at said outlet end with a first coupling portion and axial openings through which the stream of air flows and control means to selectively control the operation of said motor, and one of a plurality of interchangeable brush heads removably attached to said hair dryer, each of said heads having a core and bristles on said core and a second hub at one end of said core with a second coupling portion that interfits with said first coupling portion to removably attach said head to said first hub, said first hub supported by circumferentially spaced, radial support arms, said first hub having a first coupling portion, said arms defining axial outlet air flow passages between said arms through which said stream of air flows, said first coupling portion being a female socket having inner sides in the form of a polygon and including locking means to releasably lock one of said brush heads to said second coupling portion.

24. A hair dryer comprising:

a housing enclosing a motor driving a blower to produce a stream of air that flows through an outlet end having a handle connected to said housing at an inlet end for gripping by a user, an outlet end and axial outlet openings through which the stream of air flows and control means to selectively control the operation of said motor, said housing being hollow and generally in the shape of an ellipsoid for being hand-held, said housing having a generally cylindrical outlet section, said handle having circumferentially spaced connecting arms removably fastened at said inlet end to define inlet air flow passages in flow communication with said inlet end of said housing, said handle having a stationery section connected to said housing and a movable grip section pivotally connected to said stationary section to enable said movable grip section to pivot and be set at selected angles between an in line position and a position at right angles to said in line position.

25. A hair dryer as set forth in claim 24 wherein there are three of said connecting arms.

26. A hair dryer as set forth in claim 24 wherein said connecting arms are removably fastened by a fastener extending through each support arm and into said housing.

27. A hair dryer as set forth in claim 24 wherein said outlet section supports an outlet end hub by means of circumferentially spaced, radially extending support arms defining axially extending outlet passages.

28. A hair dryer as set forth in claim 24 including an inlet end hub with a plurality of circumferentially spaced fastening legs that insert into the inside of said inlet end of said housing to releasably fasten a screen across said air inlet end of said housing.

29. A hair dryer as set forth in claim 24 including a plurality of circumferentially spaced slots in said housing adjacent said inlet end that are covered by a screen to allow for additional air flow into said inlet end of said housing upstream of said blower.

30. A hair dryer as set forth in claim 24 wherein said control means includes a first on/off electric switch with two speed settings for the motor operated by actuating a first button and a second electric switch controlling temperature operated by actuating a second button.

31. A hair dryer comprising:

a housing enclosing a motor driving a blower to produce a stream of air that flows through an outlet end having a handle connected to said housing at an inlet end for gripping by a user, an outlet end and axial outlet openings through which the stream of air flows and control means to selectively control the operation of said motor, said housing being hollow and generally in the shape of an ellipsoid for being hand-held, said housing having a generally cylindrical outlet section supporting an outlet end hub by means of circumferentially spaced, radially extending support arms defining axially extending outlet passages, said handle having three circumferentially spaced connecting arms removably fastened at said inlet end to define inlet air flow passages in flow communication with said inlet end of said housing, said connecting arms being fastened by a fastener extending through each support arm and into said housing, said handle having a stationery section connected to said housing and a movable grip section pivotally connected to said stationary section to enable said movable grip section to pivot and be set at selected angles between an in line position and a position at right angles to said in line position, an inlet end hub with a plurality of circumferentially spaced fastening legs that insert into the inside of said inlet end of said housing to releasably fasten a screen across said air inlet end of said housing, and a plurality of circumferentially spaced slots in said housing adjacent said inlet end that are covered by a screen to allow for additional air flow into said inlet end of said housing upstream of said blower.

* * * * *